US007442893B2

(12) United States Patent
Kishimoto

(10) Patent No.: US 7,442,893 B2
(45) Date of Patent: Oct. 28, 2008

(54) SWITCH DEVICE

(75) Inventor: Takayoshi Kishimoto, Fukui (JP)

(73) Assignee: Matsushita Electric Industrial Co., Ltd. (JP)

( * ) Notice: Subject to any disclaimer, the term of this patent is extended or adjusted under 35 U.S.C. 154(b) by 0 days.

(21) Appl. No.: 11/854,021

(22) Filed: Sep. 12, 2007

(65) Prior Publication Data

US 2008/0173527 A1 Jul. 24, 2008

(30) Foreign Application Priority Data

Sep. 13, 2006 (JP) ..... 2006-247720

(51) Int. Cl.
*H01H 13/04* (2006.01)

(52) U.S. Cl. ..... 200/333; 200/564; 200/273; 200/336; 200/557

(58) Field of Classification Search ..... 200/333, 200/564, 569, 570, 273, 282, 283, 336, 557, 200/560, 19.18
See application file for complete search history.

(56) References Cited

U.S. PATENT DOCUMENTS

| | | | | |
|---|---|---|---|---|
| 4,451,720 | A * | 5/1984 | Ludwig | 200/296 |
| 4,771,149 | A * | 9/1988 | Armstrong et al. | 200/336 |
| 5,430,264 | A * | 7/1995 | Shinohara et al. | 200/47 |
| 5,595,290 | A * | 1/1997 | Hsieh | 200/571 |
| 5,894,118 | A * | 4/1999 | Nishimoto et al. | 200/527 |
| 6,288,351 | B1 * | 9/2001 | Bruntz | 200/336 |

FOREIGN PATENT DOCUMENTS

| | | |
|---|---|---|
| JP | 02-023718 | 2/1990 |

* cited by examiner

*Primary Examiner*—Kyung Lee
(74) *Attorney, Agent, or Firm*—RatnerPrestia

(57) ABSTRACT

A U-shaped spring member is placed on the outer periphery of a hollow cylindrical part of an operating body. Engaging portions in arm portions upwardly inwardly extending from both ends of the spring member are fitted into holes through the hollow cylindrical part and brought into resilient contact with a groove on the outer periphery of an operating shaft. This structure provides a switch device that has great resistance to pull-out of the operating body for secure fastening thereof and is easy to assemble.

2 Claims, 6 Drawing Sheets

SWITCH DEVICE

BACKGROUND OF THE INVENTION

1. Field of the Invention

The present invention relates to a switch device to be mainly used to operate the air-conditioner or audio equipment for a vehicle.

2. Background Art

In recent years, an increasing number of vehicles have switch devices including a various kinds of operating bodies on the front panel in the vehicle cabin for the operation of various kinds of electronic devices, such as an air-conditioner and audio equipment.

A description is provided of such a conventional switch device with reference to FIGS. 6 and 7.

FIG. 6 is a sectional view of a conventional switch device. FIG. 7 is an exploded perspective view of the conventional switch device. With reference to FIGS. 6 and 7, downwardly-projecting hollow cylindrical part 1A is formed on the bottom face of columnar operating body 1 made of an insulating resin. On the outer periphery of hollow cylindrical part 1A, a plurality of notches 1B are provided.

Operating shaft 2A of switch 2 is columnar and projects upwardly. Formed in switch 2A are a plurality of switch contacts (not shown) to be brought into or out of electrical contact with each other by rotation of operating shaft 2A. Operating shaft 2A having flat part 2B on the side face thereof is inserted in hollow cylindrical part 1A on the bottom face of operating body 1.

Spring member 3 is made of a helically wound metal wire. Spring member 3 is placed on the outer periphery of hollow cylindrical part 1A in substantially a yielding state. Hollow cylindrical part 1A is fastened by operating shaft 2A to form the switch device.

When such a switch device is assembled, first, spring member 3 is placed on the outer periphery of hollow cylindrical part 1A on the bottom face of operating body 1. Thereafter, while hollow cylindrical part 1A and spring member 3 are expanded outwardly, operating shaft 2A of switch 2 is press-fitted into hollow cylindrical part 1A.

Such a switch device is mounted on circuit board 4 having a plurality of wiring patterns (not shown) on both sides thereof, by soldering or other methods. The switch device is placed in the front panel or other parts in a vehicle cabin. At this time, switch 2 is electrically coupled to various kinds of electronic devices, such as an air-conditioner and audio equipment, or electronic circuits (not shown) of the vehicle, via connectors or leads (not shown).

In the above structure, rotary manipulation of operating body 1 rotates operating shaft 2A press-fitted into hollow cylindrical part 1A on the bottom face of operating body 1, thereby bringing switch contacts in switch 2 into or out of electrical contact with each other. The signals generated at this time are fed into the electronic devices or electronic circuits, thus changing the temperature of the air-conditioner, or the volume of the audio equipment.

In this case, flat part 2B formed on the side face of operating shaft 2A prevents operating body 1 and operating shaft 2A from turning separately with normal operating force. However, in the upward pulling direction, hollow cylindrical part 1A is fastened onto operating shaft 2A by the yielding force of spring member 3 only. Therefore, pulling operating body 1 with strong force may remove operating body 1 from operating shaft 2A.

Increasing the fastening force of spring member 3 to prevent this phenomenon enhances resistance to pull-out of operating body 1. However, when operating body 1 and switch 2 are assembled, press-fitting operating shaft 2A into hollow cylindrical part 1A by hands is difficult and jigs are necessary for the assembly.

As described above, in the conventional switch device, increasing the fastening force of spring member 3 to prevent the pull-out of operating body 1 makes the assembly of operating body 1 and switch 2 difficult and necessitates more assembly time.

The technique of the conventional switch device is disclosed in Japanese Utility Model Unexamined Publication No. H02-23718, for example.

SUMMARY OF THE INVENTION

The present invention provides a switch device that has greater resistance to pull-out of an operating body thereof and is easy to assemble.

For the switch device of the present invention, a U-shaped spring member is placed on the outer periphery of a hollow cylindrical part of the operating body that has the operating shaft of the switch inserted therein. Arm portions upwardly inwardly extending from both ends of the spring member are fitted into holes through the hollow cylindrical part and brought into resilient contact with a groove on the outer periphery of the operating shaft. The arm portions at both ends of the spring member are fitted into the groove on the operating shaft, so that the operating body is engaged by the operating shaft of the switch. This structure prevents pull-out of the operating body and ensures fastening thereof. Because the operating shaft is fastened in the hollow cylindrical part by yielding of the entire spring member, assembly thereof is easy.

DETAILED DESCRIPTION OF THE INVENTION

A description is provided of an exemplary embodiment of the present invention, with reference to FIGS. 1 through 5.

First Exemplary Embodiment

Figure 1:
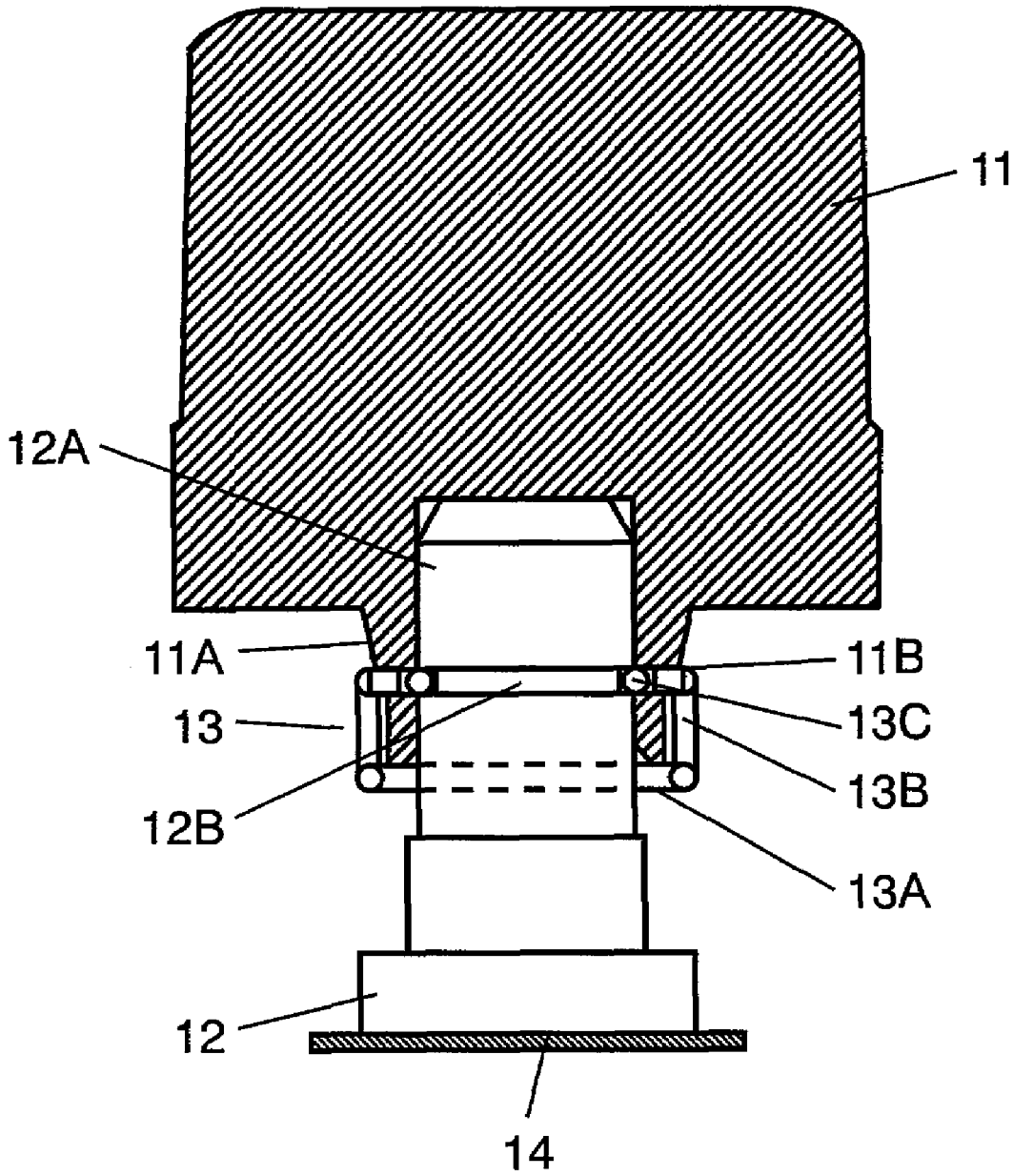
FIG. 1 is a sectional view of a switch device in accordance with a first exemplary embodiment of the present invention.
Figure 2:
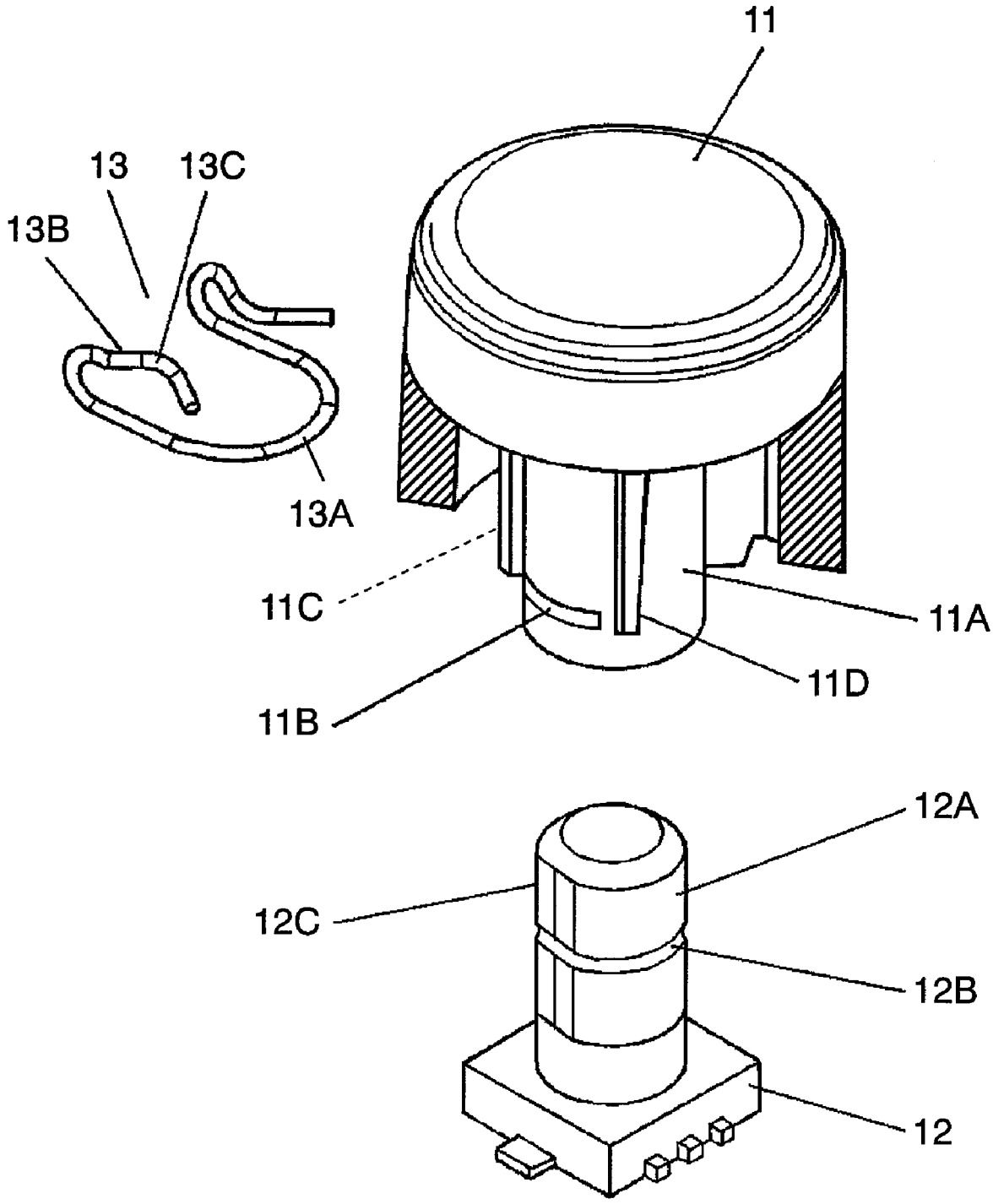
FIG. 2 is an exploded perspective view partially in section of the switch device in accordance with the first exemplary embodiment.

FIG. 1 is a sectional view of a switch device in accordance with the first exemplary embodiment of the present invention. FIG. 2 is an exploded perspective view partially in section of the switch device in accordance with the first exemplary embodiment. With reference to FIGS. 1 and 2, columnar operating body 11 is made of an insulating resin, such as acrylic and polycarbonate. On the bottom face of operating body 11, downwardly-projecting hollow cylindrical part 11A is formed. Provided on the outer periphery of hollow cylindrical part 11A are a plurality of facing holes 11B, flat part 11C, and a plurality of walls 11D formed above holes 11B.

Operating shaft 12A of switch 12 is columnar and projects upwardly. Formed in switch 12 are a plurality of switch contacts (not shown) to be brought into or out of contact with each other by rotation of operating shaft 12A. Groove 12B is formed on the outer periphery of operating shaft 12A. Flat part 12C is formed on the side face of the shaft. Operating shaft 12A is inserted in hollow cylindrical part 11A on the bottom face of operating body 11.

U-shaped spring member 13 is made of a metal wire of steel, a cupper alloy, or the like. Provided at both ends of U-shaped bent portion 13A are a plurality of arm portions 13B that are bent in the direction of bent portion 13A and extend upwardly. In the intermediate positions of arm portions 13B corresponding to the bottom end of hollow cylindrical part 11A to holes 11B, engaging portions 13C each bent inwardly into a V shape are provided.

Spring member 13 is placed on the outer periphery of hollow cylindrical part 11A in substantially a yielding state. Engaging portions 13C are fitted into holes 11B and brought into resilient contact with groove 12B on operating shaft 12A to form the switch device.

Next, a description is provided of the assembly of the switch device of the present invention.

Figure 3A:
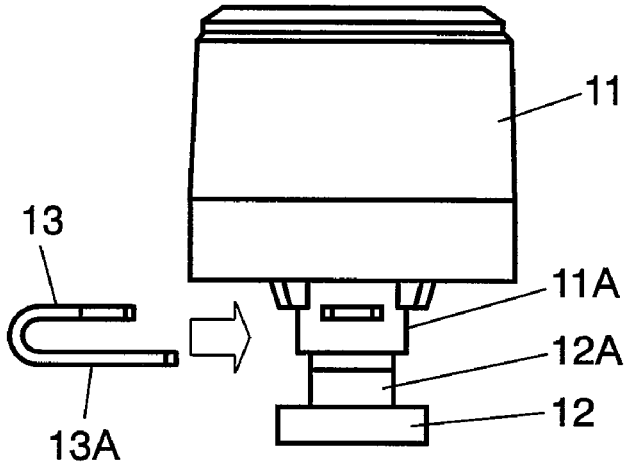
FIG. 3A is a partial side view of the switch device in accordance with the first exemplary embodiment.
Figure 3B:
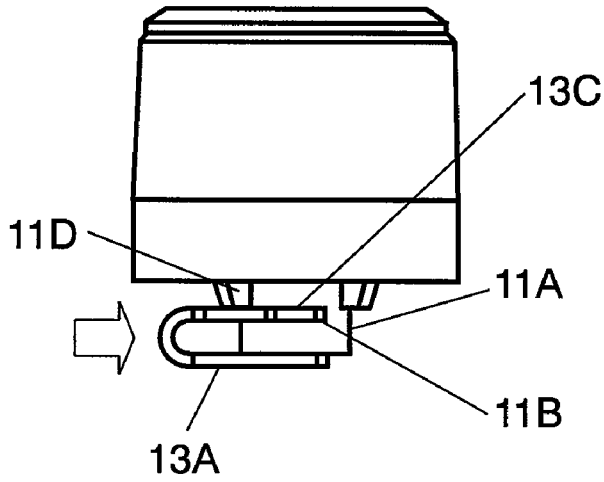
FIG. 3B is a partial side view of the switch device in accordance with the first exemplary embodiment.
Figure 3C:
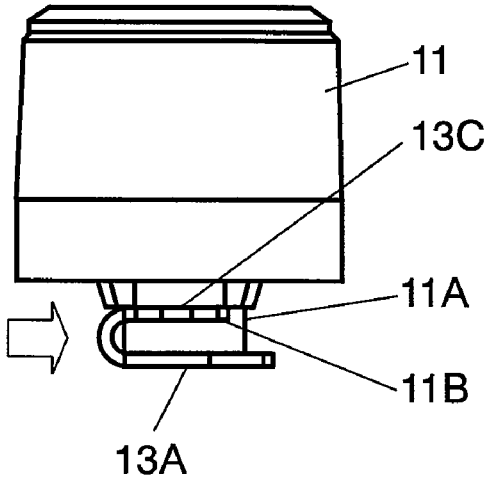
FIG. 3C is a partial side view of the switch device in accordance with the first exemplary embodiment.
Figure 4A:
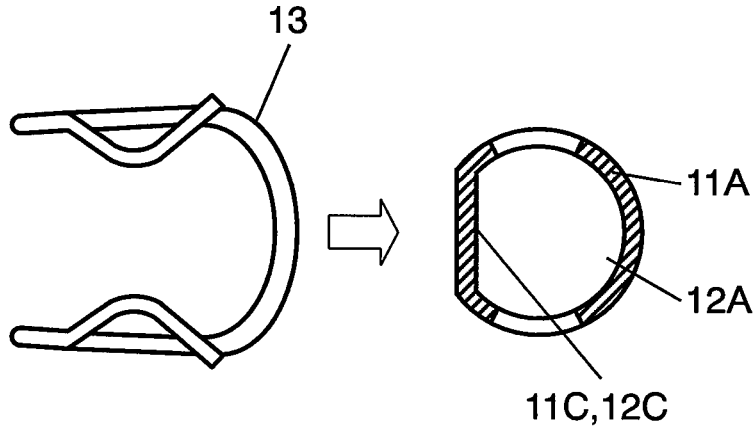
FIG. 4A is a partial plan view of the switch device in accordance with the first exemplary embodiment.
Figure 4B:
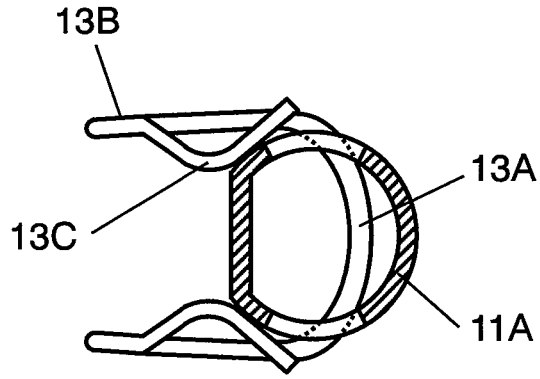
FIG. 4B is a partial plan view of the switch device in accordance with the first exemplary embodiment.
Figure 4C:
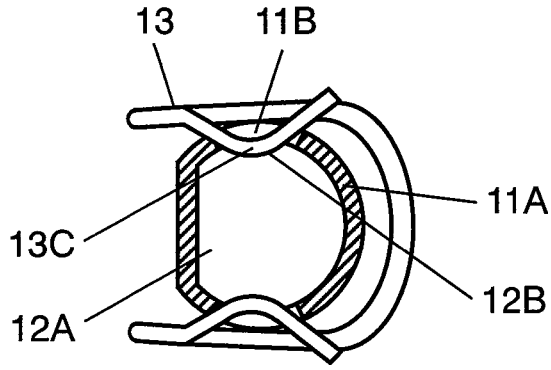
FIG. 4C is a partial plan view of the switch device in accordance with the first exemplary embodiment.

FIGS. 3A, 3B, and 3C are partial side views of the switch device in accordance with the first exemplary embodiment. FIGS. 4A, 4B, and 4C are partial plan views of the switch device in accordance with the first exemplary embodiment.

When the switch device is assembled, first, flat parts 11C and 12C are brought into contact with each other. Then, while holes 11B are aligned with groove 12B, operating shaft 12A of switch 12 is inserted into hollow cylindrical part 11A on the bottom face of operating body 11. Thereafter, spring 13 is placed from the left side of hollow cylindrical part 11A.

Next, as shown in FIG. 3B, while bent portion 13A is brought into contact with the bottom end of hollow cylindrical part 11A, spring member 13 is pressed onto the outer periphery of hollow cylindrical part 11A. Then, as shown in FIG. 4B, engaging portions 13C are brought into contact with the outer periphery of hollow cylindrical part 11A. While bent portion 13A and arm portions 13B are expanding outwardly, spring member 13 is fitted onto hollow cylindrical part 11A.

At this time, the dimension from the bottom end of hollow cylindrical part 11A to holes 11B is equal to the dimension from bent portion 13A to engaging portions 13C. Walls 11D are formed above holes 11B to make contact with the top faces of engaging portions 13C. Thus, engaging portions 13C are guided by this structure to holes 11B without any misalignment.

Then, as shown FIGS. 3C and 4C, spring member 13 is pressed until engaging parts 13C are fitted into holes 11B. The resilient restoring force of spring member 13 allows engaging portions 13C to fit into holes 11B and to make resilient contact with groove 12B on operating shaft 12A. As a result, engaging portions 13C are fitted into groove 12B, and operating body 11 is engaged by operating shaft 12A of switch 12.

As described above, when spring member 13 is placed on hollow cylindrical part 11A of operating body 11, both ends of bent portion 13A and a plurality of arm portions 13B yield outwardly, and spring member 13 is placed on hollow cylindrical part 11A by the yielding of the entire spring member. Thus, even with the use of spring member 13 having somewhat large spring load, assembly thereof is easy.

As shown FIG. 1, the switch device of the present invention is mounted on circuit board 14 having a plurality of wiring patterns (not shown) formed on both sides thereof by soldering or other methods. Then, the switch device is placed in the front panel or other parts in a vehicle cabin. At this time, switch 12 is electrically coupled to various kinds of electronic devices, such as an air-conditioner and audio equipment, or electronic circuits (not shown) of the vehicle, via connectors or leads (not shown).

In the above structure, rotary manipulation of operating body 11 rotates operating shaft 12A press-fitted into hollow cylindrical part 11A on the bottom face of operating body 11, thereby bringing switch contacts in switch 12 into or out of electrical contact with each other. The signals generated at this time are fed into the electronic devices or electronic circuits, thus changing the temperature of the air-conditioner, or the volume of the audio equipment.

As described above, because operating body 11 is fit over operating shaft 12A of switch 12 with flat parts 11C and 12C in contact with each other, rotary manipulation of operating body 11 does not make hollow cylindrical part 11A and operating shaft 2A turn separately and ensures electrical contact of switch 12.

Further, engaging portions 13C in arm portions 13B at both ends of spring member 13 are fitted into holes 11B and brought into resilient contact with groove 12B on operating shaft 12A. Engaging portions 13C are fit into groove 12B and operating body 11 is engaged by operating shaft 12A. Thus, even when operating body 11 is pulled with somewhat strong force, operating body 11 is not removed from operating shaft 12A and is securely fastened thereto.

As described above, in the first exemplary embodiment, placing U-shaped spring member 13 on the outer periphery of hollow cylindrical part 11A of operating body 11, fitting engaging portions 13C upwardly inwardly extending from both ends of spring member 13 into holes 11Bs through hollow cylindrical part 11A, and bringing the engaging portions into resilient contact with groove 12B formed on the outer periphery of operating shaft 12A can prevent pull-out of operating body 11 and ensures fastening thereof. This structure provides a switch device easy to assemble.

Figure 5:
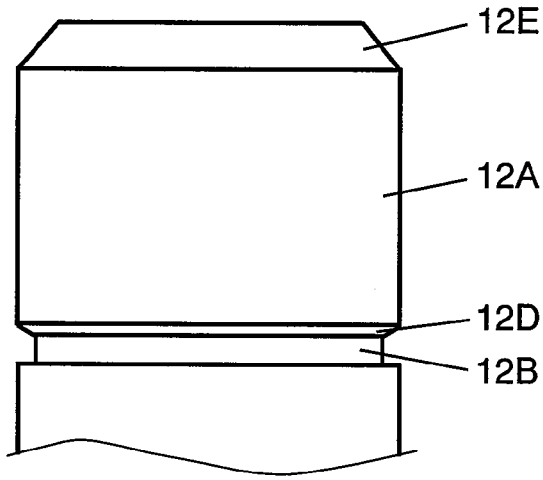
FIG. 5 is another partial side view of a switch device in accordance with the first exemplary embodiment.
Figure 6:
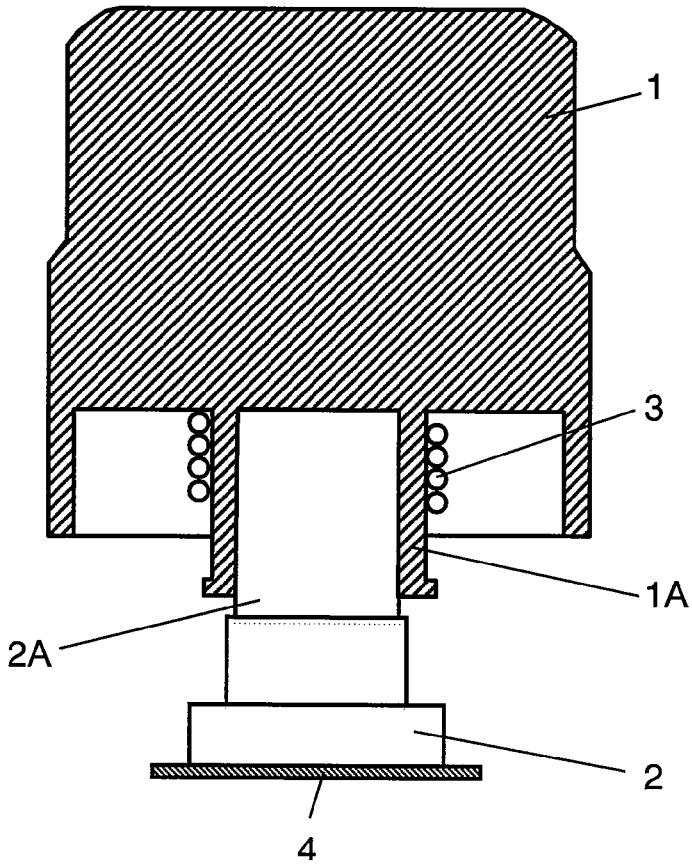
FIG. 6 PRIOR ART
FIG. 6 is a sectional view of a conventional switch device.
Figure 7:
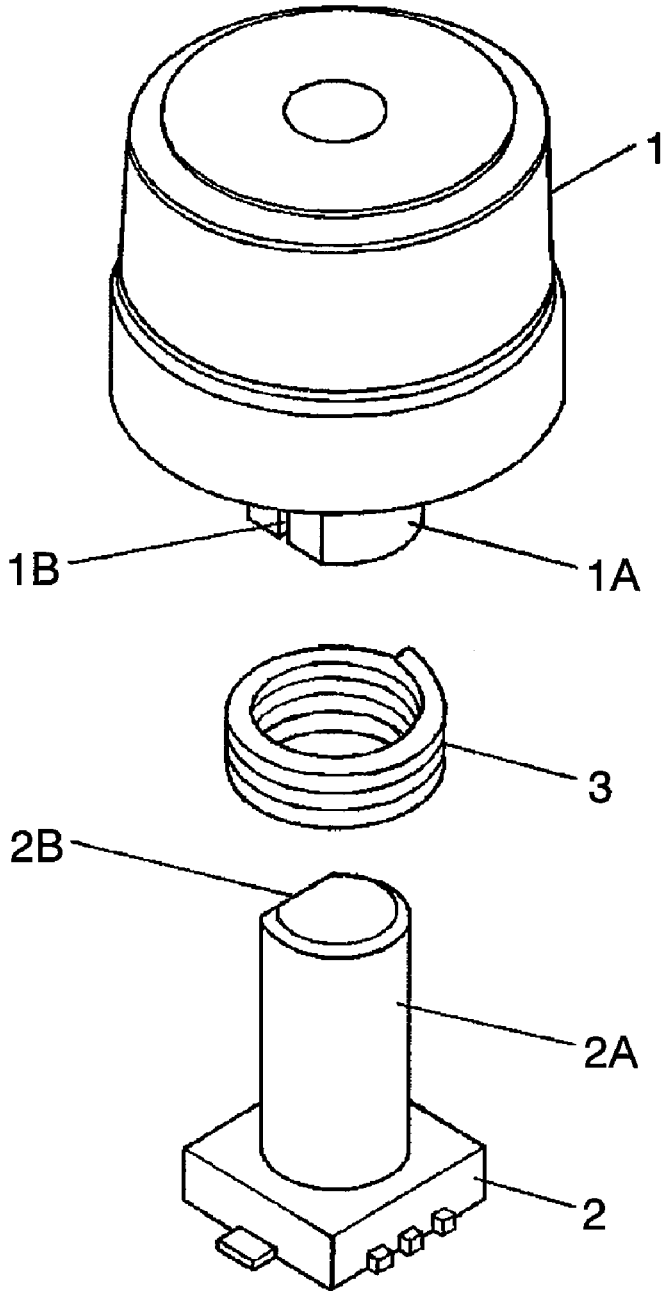
FIG. 7 PRIOR ART
FIG. 7 is an exploded perspective view of the conventional switch device.

FIG. 5 is another partial side view of a switch device in accordance with the first exemplary embodiment of the present invention. With reference to FIG. 5, bevel 12D chamfered at a predetermined angel is provided over groove 12B of operating shaft 12A. Changing the shape and size of bevel 12D can prevent operating body 11 from being pulled out by a certain degree of force. Further, operating body 11 can be pulled out easily by a force equal to or larger than a predetermined one.

In the above description, after operating shaft 12A of switch 12 is inserted into hollow cylindrical part 11A, spring member 13 is placed on the outer periphery of hollow cylindrical part 11A. Other than this structure, as shown in FIG. 5, providing bevel 12E at the tip of operating shaft 12A allows operating shaft 12A to be inserted into hollow cylindrical part 11A from the bottom thereof while spring member 13 is placed on the outer periphery of hollow cylindrical part 11A and engaging portions 13C are projected inwardly from holes 11B. The switch device of the present invention can easily be assembled with this procedure.

The switch device of the present invention enhances resistance to pull-out of the operating body and is easily assembled. Thus, the present invention is useful to operate the air-conditioner and audio equipment mainly for a vehicle.

What is claimed is:

1. A switch device comprising:

an operating body including a hollow cylindrical part, the hollow cylindrical part projecting on a bottom face of the operating body;

a switch for making or breaking electrical contact by rotation of an operating shaft projecting upwardly; and a U-shaped spring member placed on an outer periphery of the hollow cylindrical part of the operating body that has the operating shaft of the switch inserted therein, wherein, the operating shaft includes a groove formed on an outer periphery thereof;

the hollow cylindrical part includes holes therethrough;

the spring member includes arm portions upwardly inwardly extending from both ends of the spring member; and the arm portions are fitted into the holes and in resilient contact with the groove.

2. The switch device of claim 1, further including a bevel over the groove on the operating shaft.

* * * * *